US006223500B1

(12) United States Patent
Kramps

(10) Patent No.: US 6,223,500 B1
(45) Date of Patent: May 1, 2001

(54) APPARATUS AND METHOD FOR WRAPPING COMPRESSIBLE ARTICLES WITH A WEB-LIKE WRAPPING MATERIAL

(75) Inventor: Jan Kramps, Huizen (NL)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 09/340,888

(22) Filed: Jun. 28, 1999

(30) Foreign Application Priority Data

Jun. 30, 1998 (CH) ..... 1389/98

(51) Int. Cl.[7] ..... B65B 13/20; B65B 11/10

(52) U.S. Cl. ..... 53/399; 53/439; 53/466; 53/528; 53/586; 53/229

(58) Field of Search ..... 53/399, 466, 439, 53/586, 228, 528, 229

(56) References Cited

U.S. PATENT DOCUMENTS

| | | | | |
|---|---|---|---|---|
| 3,385,026 | * | 5/1968 | Schmremund | 53/228 |
| 3,469,368 | * | 9/1969 | Churchill | 53/228 |
| 3,504,476 | | 4/1970 | Ehrefried et al. . | |
| 4,738,078 | | 4/1988 | Benz et al. . | |
| 5,189,864 | | 3/1993 | Cinotti et al. . | |
| 5,733,099 | * | 3/1998 | Onneger | 53/587 |

FOREIGN PATENT DOCUMENTS

| | | |
|---|---|---|
| 865077 | 4/1961 | (GB) . |
| 2009085 | 6/1979 | (GB) . |

OTHER PUBLICATIONS

GB 2293165A abstract, Mar. 1996.*

* cited by examiner

*Primary Examiner*—John Sipos
(74) *Attorney, Agent, or Firm*—Alston & Bird LLP

(57) ABSTRACT

The apparatus for wrapping compressible box-like articles (10) such as a stock of newspapers or magazines, with a web-like wrapping material (12). The apparatus has three serially arranged belt conveyors (16, 18, 20), and the second belt conveyor (18) is in the form of a bearing table (24) which can be rotated about a vertical axis (26). The bearing table mounts two pressure-exerting members (30, 32). The article (10') which is to be wrapped is introduced in a compressed state, by the first belt conveyor (16), into a wrap-around channel (42) which is formed by the table (24) and one of the pressure-exerting members (30), and the wrapping material (70) is positioned around the article in the form of a U. At the same time, the article (10), which has been previously wrapped in this way, is transferred to the third belt conveyor (20). A guide arrangement (62) for the wrapping material is then moved in a downward direction forming a loop of the material which is composed of a first end section (76) and a parallel second end section (78) which is guided along the trailing side (82) of the article. The loop of the material (70) is then severed at the base of the loop and the bearing table (24) is rotated in order that, as the article (10') is transferred to the third belt conveyor (20), the end section (78) is positioned against the article (10') to complete the wrapping. The first end section (76) is positioned to be engaged by the next article as it is advanced onto the table (24).

17 Claims, 3 Drawing Sheets

APPARATUS AND METHOD FOR WRAPPING COMPRESSIBLE ARTICLES WITH A WEB-LIKE WRAPPING MATERIAL

BACKGROUND OF THE INVENTION

The present invention relates to an apparatus for wrapping compressible articles, such as stacked printed products, with a web-like wrapping material.

An apparatus of the above type is known from EP-A-0 120 251 and the corresponding U.S. Pat. No. 4,738,078. In the known apparatus, the articles which are to be wrapped are introduced in the compressed state into a wrap-around channel, which is formed by a bearing table and a pressure-exerting arrangement assigned thereto, and at the same time are wrapped in the form of a U by a foil or web-like material. A guide arrangement then guides the material web, with the formation of a material-web loop, along the trailing side of the article, as seen in the conveying direction, and at the same time forms, on the one hand, a first material-web section and, on the other hand, a second material-web section, which runs on the trailing side of the article and of which the length is greater than the dimension of the article in the longitudinal direction of said second material-web section. The tensioned material-web sections are secured by means of retaining devices, which for this purpose have pins which pierce the material web. The material web is then severed between the two retaining devices by means of a stationary cutting arrangement. Once the stationary pressure-exerting arrangement has been raised, the bearing means, with the wrapped article and the second material-web section retained under tensile stressing, is rotated through 180°. As the wrapped article is conveyed from the bearing table onto a belt conveyor, the projecting end section of the second material-web section is wrapped around against the base of the article once it has been released.

As the bearing means is rotated, the article is retained solely by its own weight and the tensioned, and secured, second material-web section. This requires, on the one hand, a material web of certain strength and, on the other hand, in order to allow quick rotation, the at least virtually central arrangement of the article on the bearing table, with the result that the axis of rotation of said table runs at least approximately through the center of gravity of the article.

Taking this prior art as departure point, it is an object of the present invention to develop the apparatus of the described type such that, even when a less strong, and thus less expensive, material web is used, quicker rotation of the bearing means, and thus a reduction in the time necessary for wrapping the article, is made possible.

SUMMARY OF THE INVENTION

The above and other objects and advantages of the present invention are achieved by the provision of an apparatus which includes a conveyor system for serially conveying an article to be wrapped from a first position to a second position which includes a bearing table which is rotatable about a vertical axis, and to a third position. A pressure exerting arrangement is mounted to and above the bearing table for compressing an article positioned on the bearing table, and such that the pressure exerting arrangement rotates with the bearing table about the vertical axis, and such that the pressure exerting arrangement and the bearing table define a wrap around channel for receiving an article to be wrapped from the first position. A web guide arrangement is provided for withdrawing a section of the web-like wrapping material from a supply which has a length sufficient to at least substantially surround the article to be wrapped, and positioning the section so that it is engaged by and at least partially wrapped about three sides of the article to be wrapped as it is moved into the wrap around channel from the first position. Also, a portion of the section overlies and extends beyond a trailing side of the article to be wrapped as it advances into the wrap around channel. Upon rotation of the bearing table and the continued advance of the article to be wrapped to the third position, the section of the web-like wrapping material is thereby completely wrapped about the article.

The wrapped article is maintained in a compressed state between the bearing table and the pressure-exerting arrangement as the bearing table is rotated, which, on the one hand, results in the wrapping material butting closely against the article and, on the other hand, makes very quick rotation of the bearing table possible even when the article is arranged eccentrically with respect to the axis of rotation. In addition, it is no longer necessary for the wrapping material to absorb retaining forces for the article as the bearing table is rotated.

In the case of a particularly preferred embodiment of the apparatus according to the invention, the bearing table mounts two spaced-apart pressure-exerting members which are controlled independently of one another with respect to its distance from the bearing table. This allows a further article which is to be wrapped to be introduced between the bearing table and one of the pressure-exerting members, while another article, which has already been wrapped and is arranged between the bearing table and the other pressure-exerting member, is conveyed away from the bearing table. In this case, the articles may be of different dimensions.

BRIEF DESCRIPTION OF THE DRAWINGS

The invention will be explained in more detail with reference to an exemplary embodiment illustrated in the drawing, in which, purely schematically.

DETAILED DESCRIPTION OF THE PREFERRED EMBODIMENT

Figure 1:
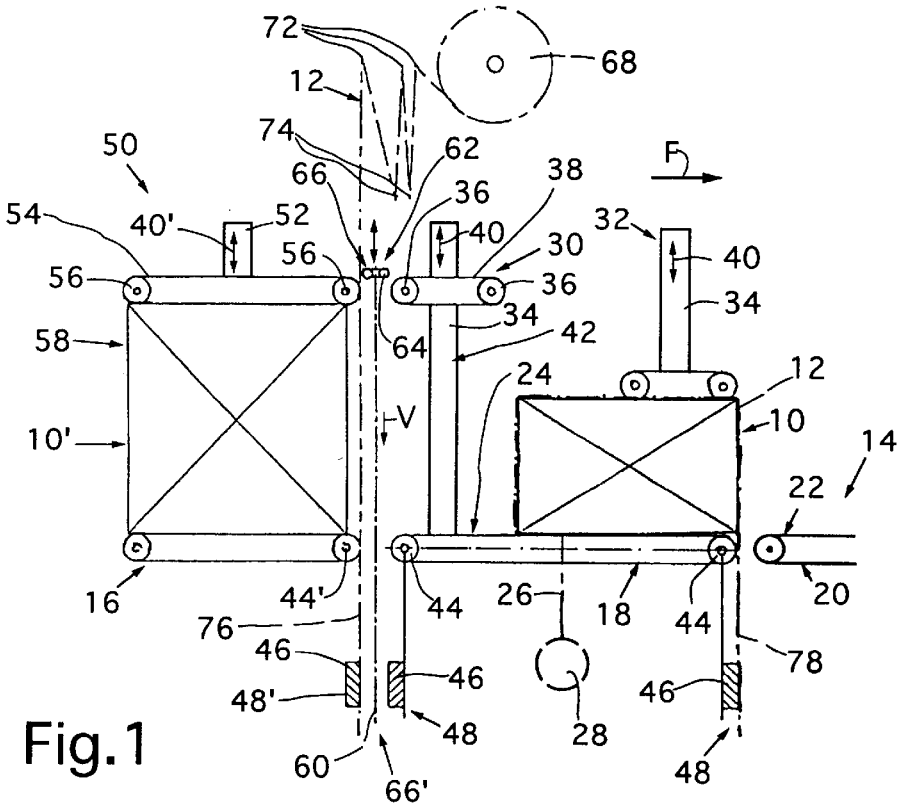
FIG. 1 shows a view of the essential parts of an apparatus according to the invention with an article which is to be wrapped and with an article which is arranged on a rotatable bearing table and has already been partially wrapped.

The apparatus which is shown in the figures and is intended for wrapping box-like articles 10, 10' with a web-like wrapping material 12 has a conveying arrangement 14 with three belt conveyors 16, 18 and 20 arranged one behind the other. These belt conveyors define a linear movement path 22 for the articles 10, 10' which are to be wrapped, and which includes a first position defined by the conveyor 16, a second position defined by the conveyor 18, and a third position defined by the conveyor 20.

The central belt conveyor 18 of the three belt conveyors forms a bearing table 24, which can be rotated about a centrally arranged axis 26 which runs in the vertical direction and at right angles to the movement path 22. A schematically indicated rotary drive 28 is intended for rotating the bearing table 24 through 180° in each case.

A pressure-exerting arrangement is mounted to the rotatable framework part of the belt conveyor 18 and can be rotated about the axis 26 together with the same. The pressure-exerting arrangement includes two separate members 30, 32, each having a vertically running guide rail 34 which is fastened on the framework part and on which an endless pressure-exerting belt 38, which is guided around rollers 36, is mounted such that it can be adjusted in height by means of a schematically indicated drive 40. The two pressure-exerting belts 38 of the pressure-exerting members 30, 32 can be adjusted individually in height, and thus in distance from the second belt conveyor 18, but are driven reversibly in synchronism with the second belt conveyor 18. Each of the pressure-exerting members 30, 32 forms, with the second belt conveyor 18, a wrap-around channel 42 for the purpose of wrapping the wrapping material 12 in the form of a U around the article 10 which is to be wrapped. The length of the pressure-exerting members 30, 32, measured in the longitudinal direction of the second belt conveyor 18, is smaller than the length of the second belt conveyor 18 minus the length of the largest article 10 which is to be wrapped, measured in the longitudinal direction of the second belt conveyor 18. Furthermore, the radially outer roller 36 in relation to the axis 26 is arranged vertically above the associated deflection roller 44 of the second belt conveyor 18.

Furthermore, at both ends, and beneath the second belt conveyor 18, the bearing table 24 has a retaining arrangement 48, which is designed as a vacuum-producing bar 46.

The distance between the first belt conveyor 16 and the second belt conveyor 18, on the one hand, and the latter belt conveyor and the third belt conveyor 20, on the other hand, is selected to be as small as possible but such that the second belt conveyor 18 can be rotated about the axis 26.

The first belt conveyor 16, which is located upstream in the conveying direction F in relation to the second belt conveyor 18, is assigned a further pressure-exerting arrangement 50. The latter has a further pressure-exerting belt 54, which can be adjusted in height, by means of a drive 40', along a vertical, further guide rail 52 and is guided around further rollers 56. Said further pressure-exerting belt 54 and the first belt conveyor 16 form a pressing channel 58 for the article 10 which is to be wrapped in each case.

Arranged in a stationary manner beneath the deflection roller 44' of the first belt conveyor 16, which deflection roller is located downstream as seen in the conveying direction F, is a further retaining arrangement 48', which is likewise designed as a vacuum-producing bar 46.

A movement path 60 of a web guide arrangement 62, which is indicated by chain-dotted lines, runs in the vertical direction V between the first belt conveyor 16 and the second belt conveyor 18. The guide arrangement 62, which has two deflection rollers 64 arranged one beside the other in an axis-parallel manner, can be moved vertically downward from a rest position 66, which is shown in FIG. 1 and is located above the highest position of the pressure-exerting belts 38, 54, into a severing position 66', which is shown in FIG. 7, and back again. The severing position 66' is located beneath the retaining arrangements 48 and 48'.

The web-like wrapping material 12 is drawn off from a supply roll 68 arranged above the conveying arrangement 14 and the pressure-exerting arrangements 30, 32, 50. From the supply roller 68, the material 70, forming supply loops, runs around a variety of stationary rollers 72 and compensating rollers 74 arranged therebetween. The free end of the material 70 runs through between the first belt conveyor 16 and second belt conveyor 18 by way of the first material section 76, the movement path 22 of the article 10 which is to be wrapped being intersected in the process, and is retained at the free end region by the stationary retaining arrangement 48'.

In the example shown, the articles 10, 10' which are to be wrapped are stacks, of different heights, of printed products such as newspapers, periodicals or the like. The wrapping material 12 is a self-adhering plastic film.

The functioning of the apparatus will now be explained with reference to the rest of the figures, which contain those designations which are necessary for understanding.

In FIG. 1, an article 10 which has already been partially wrapped is located on the second conveying belt 18. It is kept in a compressed state between said conveying belt and the downstream pressure-exerting member 32. The wrapping material runs around the article 10 in the clockwise direction from approximately the center of the underside of the article 10, as is indicated by chain-dotted lines, and has an end section 78 running between the second belt conveyor 18 and the third belt conveyor 20 to the corresponding retaining arrangement 46, where the end region of the end section 78 is retained.

A further article 10' which is to be wrapped is located in the pressure channel 58, which is formed by the first belt conveyor 16 and the further pressure-exerting arrangement 50. Said article 10' is kept in a compressed state between the first belt conveyor 16 and the further pressure-exerting arrangement 50. The pressure-exerting member 30 of the bearing table 24, and which faces the first belt conveyor 16, is set to the height of the further pressure-converting arrangement 50 by means of the drive 40.

Figure 2:
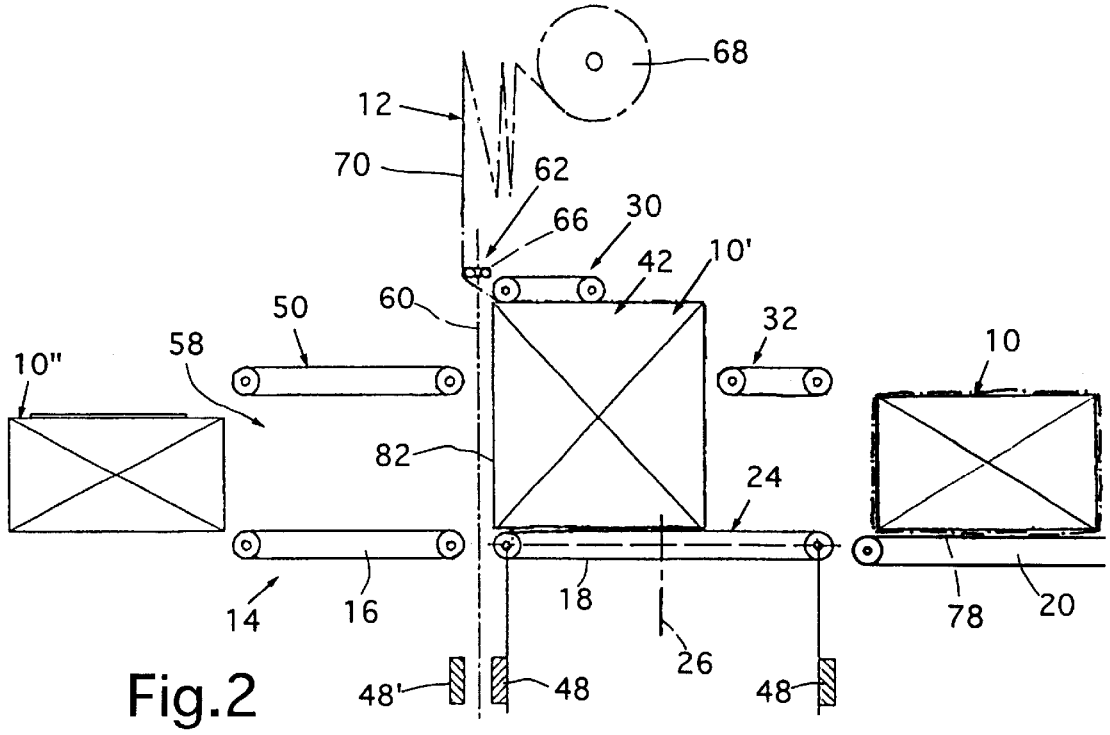
FIG. 2 shows, in an illustration similar to FIG. 1, the apparatus of FIG. 1 at a later point in time, it being the case that the article which is to be wrapped has been conveyed onto the bearing table and the article which has previously been partially wrapped has been conveyed away from the bearing table in a now fully wrapped state.

Then all three belt conveyors 16, 18, 20 are driven in the conveying direction F at the same time and speed, to be precise until such time as the article 10' which is to be wrapped is located on the bearing table 24, fully in the wrap-around channel 42, and the article 10, which has previously already been partially wrapped is located on the third belt conveyor 20, as FIG. 2 shows. As the article 10 is conveyed from the second belt conveyor 18 onto the third belt conveyor 20, the end section 78 is wrapped around against the underside of the article 10, it being the case that the two end regions of the material overlap with one another and, as a result of their adherence properties, are connected to one another. The article 10, which is located on the third belt conveyor 20, is thus fully wrapped.

As the other article 10' is conveyed from the first belt conveyor 16 onto the second belt conveyor 18, its leading side, as seen in the conveying direction F, comes into abutment against the first material section 76, as a result of which, during passage into the wrap-around channel 42, said material section 76 is wrapped around the base of the article 10 and also is wrapped around the top side of the article 10. Further wrapping material is drawn off from the supply loop and the supply roll 68 in the process. In this case, the material 70 runs around that deflection roller 64 of the guide arrangement 62 which is shown on the left-hand side in the figures and, from said deflection roller, runs, between the article 10' and the pressure-exerting belt 38 of the pressure-exerting member 30, around the article 10' in the form of a U approximately centrally to the base of the latter.

Figure 7:
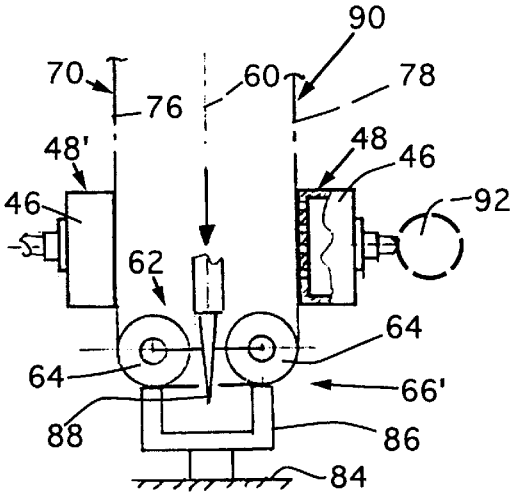
FIG. 7 shows the guide arrangement shown in FIG. 6, in its bottom, end position, in which the wrapping material is severed by means of a cutting arrangement.
Figure 6:
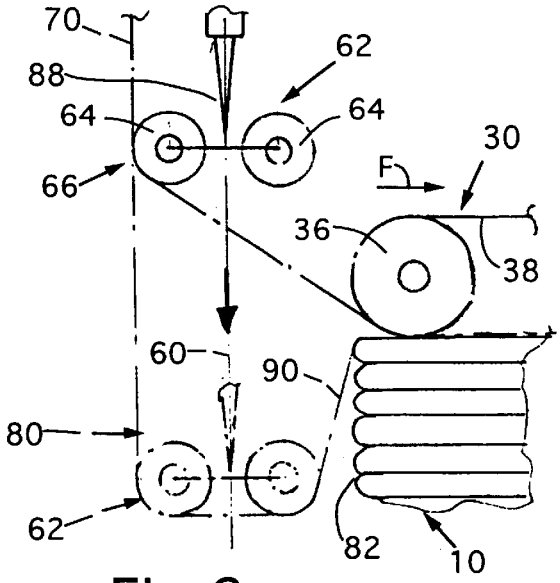
FIG. 6 shows part of the apparatus shown in FIGS. 1 to 5, with a guide arrangement for the wrapping material in its top, rest position and, as indicated by chain-dotted lines, during the formation of the material loop.

Then, as can be seen from FIGS. 6 and 7, the guide arrangement 62 is moved from its rest position 66 into the severing position 66'. As a result, the material 70, with the formation of a material loop 80, is guided along the trailing side 82 of the article 10, as seen in the conveying direction F, to beneath the conveying arrangement 14 and the corresponding retaining arrangements 48, 48'; see also FIG. 3.

The severing position 66' of the guide arrangement 62 is shown in FIG. 7. As it moves through the two mutually facing retaining arrangements 48 and 48', the material 70 is positioned against the two vacuum-producing bars 46, which are subjected to the action of negative pressure, as a result of which the material 70 is secured. A cross-sectionally U-shaped bearing element 86 is fastened on a schematically indicated machine framework 84, on which the rest of the parts of the apparatus are arranged in a manner which is not shown but is known in general. The material 70 is clamped between the leg ends of the bearing element 86 and the deflection rollers 64 of the guide arrangement 62. Between the two deflection rollers 64, the guide arrangement 62 has a cutting blade 88, which can be displaced in the downward direction from a retracted position, which is shown in FIG. 6 and is approximately level with the axes of the deflection rollers 64, into a cutting position, which is beyond the bottom tangent to the two deflection rollers 64. During this movement, the clamped material 70 is severed to give the first material section 76 and a second material section 90 with the end section 78.

As can be gathered from FIG. 7, the vacuum-producing bars 46 have a hollow, cross-sectionally rectangular bar, of which the interior is connected to a schematically indicated negative-pressure source 92 and of which the side which faces the material 70 is provided with a multiplicity of through-passage holes.

On the inlet side of the first belt conveyor 16, FIG. 2 shows a further article 10", on which a cover sheet is located. The further pressure-exerting arrangement 50 has been displaced, in terms of its distance from the first belt conveyor 16, to a height which is slightly higher than the corresponding dimension of the article 10".

Figure 3:
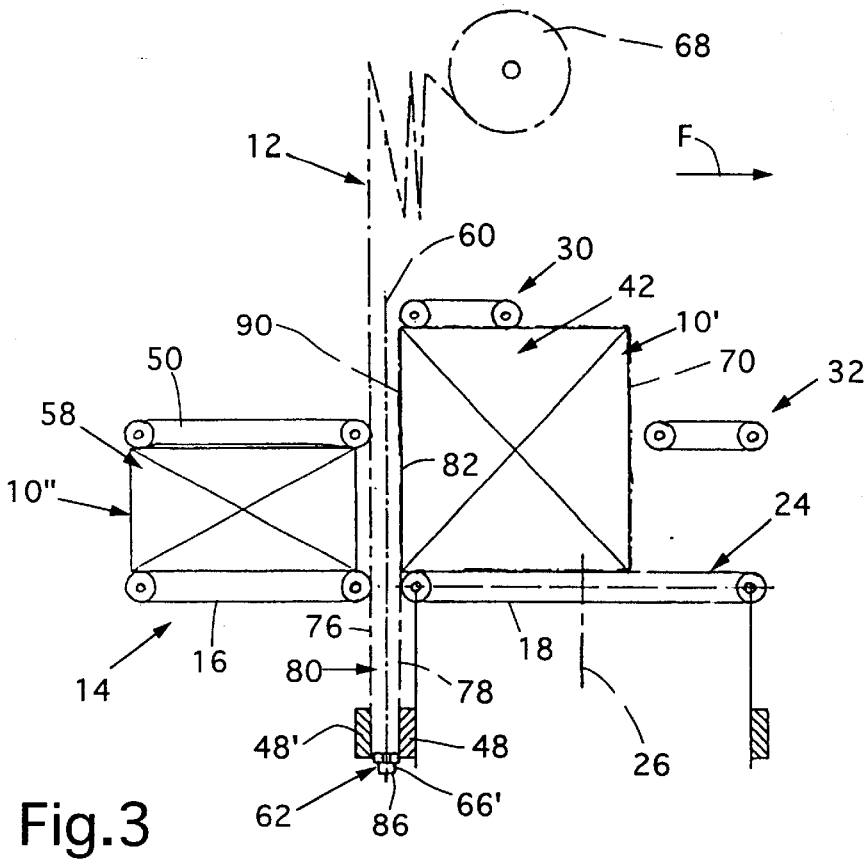
FIG. 3 shows the apparatus of FIGS. 1 and 2 at a yet later point in time, it being the case that the wrapping material has been drawn through, with the formation of a loop, between the partially wrapped article, which is arranged on the bearing table, and a following article which is to be wrapped.

As is shown in FIG. 3, this article 10" is introduced into the pressure channel 58 and compressed by the further pressure-exerting arrangement 50 being lowered. The article 10', which has previously been partially wrapped, is located on the bearing table 24, it being the case that the guide arrangement 62 is located in the severing position 66', which is shown in FIG. 7, and the cutting blade 88 severs the material 70. Furthermore, the pressure-exerting belt 38 of the pressure-exerting member 32 has been lowered at the same time as that of the further pressure-exerting arrangement 50, and to the same height.

Figure 4:
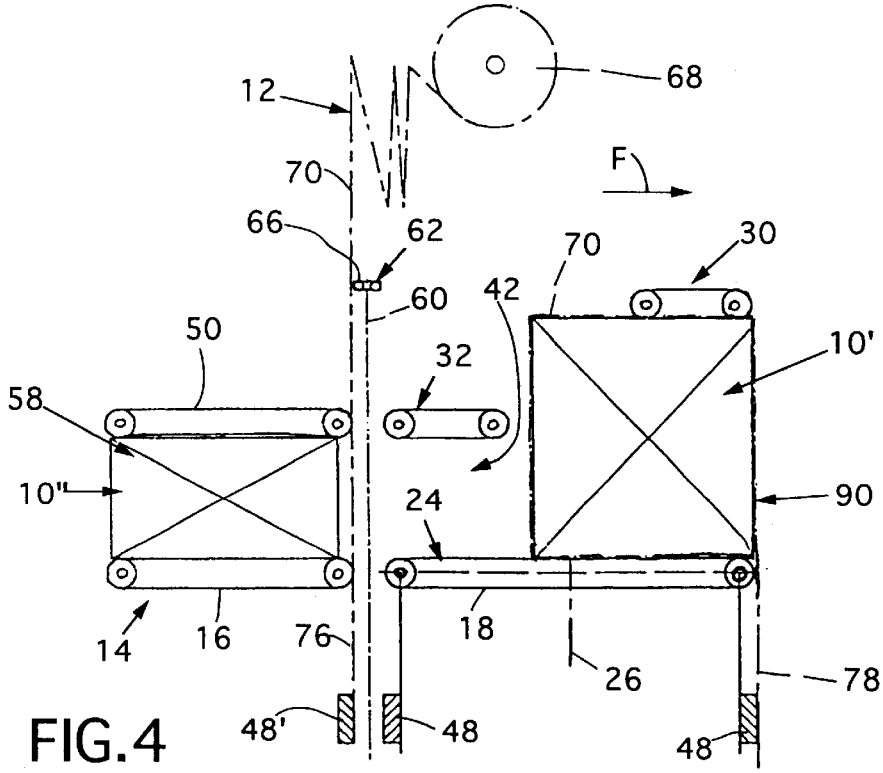
FIG. 4 shows the apparatus of FIGS. 1 to 3 with the bearing table rotated through 180° and with a further article which is to be wrapped and in a position for being conveyed onto the bearing table.

The bearing table 24 is then rotated through 180° about the axis 26. The situation achieved as a result is shown in FIG. 4. In the same way as in FIG. 1, the first material section 76 runs past the leading side, as seen in the conveying direction F, of the article 10", which is located in the pressing channel 58, and the guide arrangement 62 has been raised again into its rest position 66. The wrap-around channel 42 on the bearing table 24 is then ready for receiving the article 10". The situation which is shown in FIG. 4 corresponds to that of FIG. 1.

Figure 5:
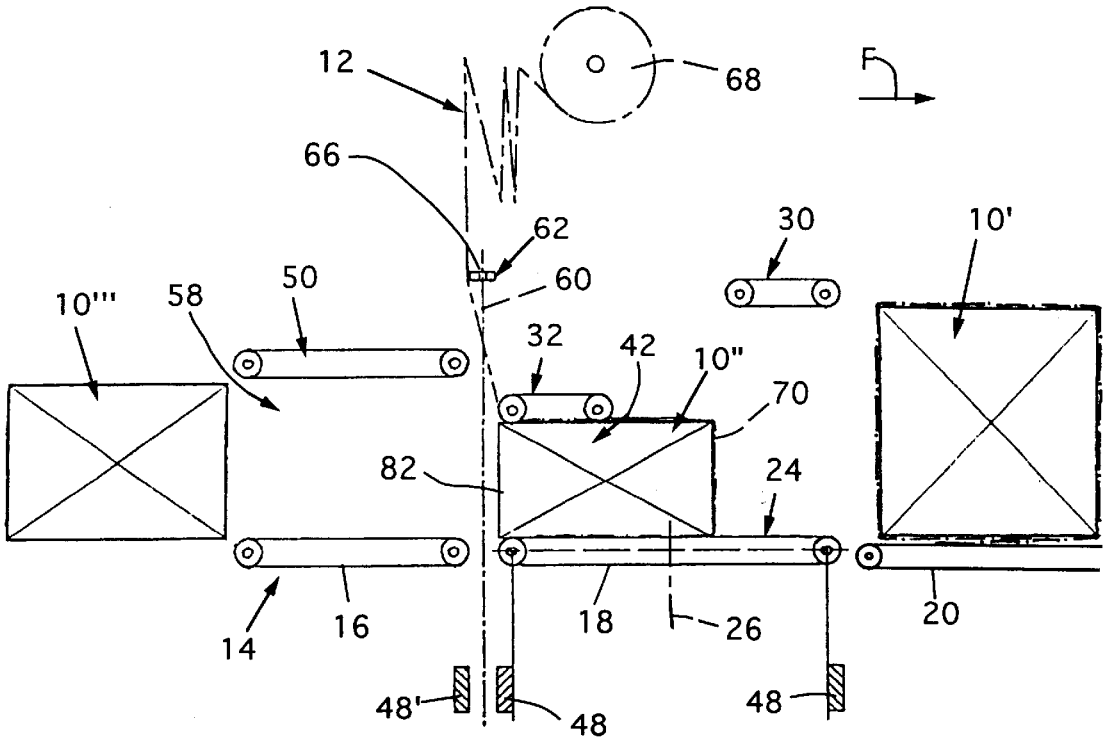
FIG. 5 shows the apparatus of FIGS. 1 to 4 at an even later point in time, wherein the next article which is to be wrapped has been conveyed onto the bearing table and the previously wrapped article has been conveyed away from said bearing table.

Then all three belt conveyors 16, 18, 20 and the pressure-exerting belts 38, 54 are driven in the conveying direction F again, as a result of which, on the one hand, the article 10", which is located in the pressure channel 58, is introduced into the wrap-around channel 42, the material 70 being wrapped around in the process, and at the same time the other article 10' is transferred from the bearing table 24 onto the third belt conveyor 20, see FIG. 5. In this case, the end section 78 is positioned against this article. A further article 10''' is ready to be introduced between the first belt conveyor 16 and the further pressure-exerting arrangement 50. The now free pressure-exerting arrangement 30 can then be adjusted to the height of the further pressure-exerting belt 54 of the further pressure-exerting arrangement 50.

One article after the other is wrapped by virtue of these steps being repeated.

Since the articles 10, 10', 10", 10''' are kept in a compressed state between the second belt conveyor 18 and the corresponding pressure-exerting member 30, 32 as the bearing table 24 is rotated, there is no need for the retaining arrangement 48 to exert any tensile force on the end section 78. Rather, all it need do is prevent the end section from moving freely and fluttering about during the rotation. This allows the permanent connection of the vacuum-producing bars 46 to the negative-pressure source; the material 70 can be drawn off from the vacuum-producing bars 46 with just a small tensile force as the article 10, 10', 10", 10''' is conveyed further in each case. Of course, the apparatus has a control arrangement (not shown) for activating all the drives of the apparatus.

The apparatus shown is suitable for wrapping not just stacks of printed products, but also packages or individual newspapers, periodicals or the like. Whereas printed products are usually compressible, this is not necessarily the case with other such box-like articles. In other to avoid any damage, the pressure-exerting arrangements may be provided, for example, with pressure sensors, in order to prevent further lowering once a certain compressive force has been achieved.

Instead of the conveying belts and pressure-exerting belts, roller conveyors are also suitable. Whereas, the belt conveyors 14 and 20 are driven in start/stop operation, the second belt conveyor 18 and the pressure-exerting belts 38 of the pressure-exerting members 30 and 32 are driven by means of a reversible drive.

It is also possible for the bearing table to be assigned more than two, for example three or four, pressure-exerting members. These are then distributed uniformly in the peripheral direction and each pressure-exerting member is assigned its own reversible belt conveyor or a corresponding conveying arrangement.

What is claimed is:

1. An apparatus for wrapping compressible articles with a web-like wrapping material comprising a conveyor system for serially conveying an article to be wrapped from a first position to a second position which includes a bearing table which is rotatable about a vertical axis, and to a third position, means for rotating the bearing table about the vertical axis;

a pressure exerting arrangement mounted to and above said bearing table for compressing an article positioned on the bearing table, and such that the pressure exerting arrangement rotates with the bearing table about the vertical axis, and such that the pressure exerting arrangement and the bearing table define a wrap around channel for receiving an article to be wrapped from the first position, said pressure exerting arrangement comprising at least two spaced apart pressure exerting members and means for independently controlling said exerting members with respect to the distance they are positioned above the bearing table, a web guide arrangement for withdrawing a section of the web-like wrapping material from a supply which has a length sufficient to at least substantially surround the article to be wrapped, and positioning the section so that it is engaged by and at least partially wrapped about three sides of the article to be wrapped as it is moved into the wrap around channel from the first position, and then guiding a portion of the section so as to overlie and extend beyond a trailing side of the article to be wrapped, and wherein upon rotation of the bearing table and the continued advance of the article to be wrapped to the third position, the section of the web-like wrapping material is completely wrapped about the article.

2. The apparatus as defined in claim 1 wherein the two pressure exerting members are arranged symmetrically on opposite sides of a vertical plane which passes through the center of the bearing table.

3. The apparatus as defined in claim 1 wherein said bearing table comprises a belt conveyor, and a reversible drive for the belt conveyor.

4. The apparatus as defined in claim 3 wherein said two spaced apart pressure exerting members each comprise a belt conveyor and a reversible drive.

5. The apparatus as defined in claim 1 wherein said first position of said conveyor system comprises a belt conveyor, a drive for selectively rotating the belt conveyor, and a pressure exerting member positioned above the belt conveyor for initially compressing the articles to be wrapped and so that an article may be introduced into the wrap around channel in a compressed state.

6. The apparatus as defined in claim 1 further comprising a web retaining member mounted to and below the level of the bearing table for retaining the portion of the wrapping material which extends beyond the trailing side of the article to be wrapped, during rotation of the bearing table about the vertical axis.

7. The apparatus as defined in claim 1 wherein said web guide arrangement includes at least one deflection roller mounted for movement in a vertical direction between the first position of the conveyor system and the bearing table so as to form a vertical loop of the wrapping material, and a cutter for severing the wrapping material into a first section and a second section, and such that the second section forms said portion of the wrapping material which overlies and extends beyond the trailing side of the article to be wrapped.

8. The apparatus as defined in claim 7 further comprising a first web retaining member mounted below the first position of the conveyor system for releasably retaining the first web section, and a second web retaining member mounted to and below the level of the bearing table for releasably engaging the second web section.

9. The apparatus as defined in claim 8 wherein said bearing table mounts two of said second web retaining members positioned adjacent opposite ends thereof such that each of said second web retaining members may be positioned adjacent said first web retaining member upon rotation of said bearing table.

10. The apparatus as defined in claim 9 wherein said first web retaining member and each of said second web retaining members are in the form of a vacuum producing bar.

11. The apparatus as defined in claim 1 wherein said first, second, and third positions of said conveyor system are linearly aligned, and wherein said bearing table is rotatable about said vertical axis through at least 180°.

12. The apparatus as defined in claim 1 wherein said pressure exerting arrangement comprises more than two of said pressure exerting members.

13. A method of wrapping compressible articles with a web-like wrapping material, comprising the steps of withdrawing a web-like wrapping material from a supply so as to form a free end section which extends downwardly across a predetermined conveying path of an article to be wrapped, conveying the article to be wrapped along said conveying path and into engagement with the free end section of the wrapping material, while compressing the article in a vertical direction by contact with one of two pressure exerting members which are spaced apart and positioned above respective opposite ends of a bearing table which is located immediately downstream of the free end section of the wrapping material, and such that the wrapping material is at least partially wrapped about three sides of the article and an end portion of the material overlies and extends beyond a trailing side of the article, then rotating the bearing table and the article and the two pressure exerting members about a vertical axis, while maintaining the one pressure exerting member in compressive contact with the article, and then conveying the article to a further position while causing the end portion of the material which extends beyond the trailing side of the article to overlie at least a portion of the bottom side of the article; and wherein a second one of the two pressure exerting members is adjusted in elevation to accommodate a next article to be wrapped prior to the rotation of the bearing table and the two pressure exerting members about the vertical axis being completed.

14. The method as defined in claim 13 comprising the further steps of vertically compressing the article to be wrapped immediately upstream of the free end section of the wrapping material, and wherein the downstream compression is adjusted to conform to the upstream compression.

15. The method as defined in claim 13 wherein the one pressure exerting member is maintained in compressive contact with the article while the article is conveyed to said further position.

16. The method as defined in claim 15 wherein the step of withdrawing a web-like wrapping material includes forming a downwardly extending loop of the material and then severing the wrapping material adjacent the loop, so as to form said free end section and a parallel end section which is upstream of said free end section in the conveying direction.

17. The method as defined in claim 13 wherein the rotating step comprises rotating the bearing table, the article, and the two pressure exerting members through 180° about said vertical axis.

* * * * *